US005350508A

United States Patent [19]

Van der Watt

[11] Patent Number: 5,350,508

[45] Date of Patent: Sep. 27, 1994

[54] POOL SKIMMING DEVICE

[76] Inventor: Lourens Van der Watt, 7 Ashley Avenue, Bryanston, Sandton, Transvaal, South Africa

[21] Appl. No.: 102,982

[22] Filed: Jul. 28, 1993

Related U.S. Application Data

[63] Continuation-in-part of Ser. No. 66,914, May 24, 1993, abandoned, which is a continuation of Ser. No. 856,460, Mar. 24, 1992, abandoned.

[51] Int. Cl.[5] ..... E04H 4/16

[52] U.S. Cl. ..... 210/169; 210/199; 210/220; 210/237; 210/238; 210/242.1; 210/242.2; 210/249; 210/470; 210/497.01; 15/1.7

[58] Field of Search ..... 210/470, 169, 497.01, 210/242.1, 199, 237, 238, 776, 416.2, 459, 462, 249, 242.2, 220; 261/DIG. 75; 15/1.7

[56] References Cited

U.S. PATENT DOCUMENTS 3,063,077 11/1962 Pansini .
3,863,237 1/1975 Doerr .
4,003,100 1/1977 Whitaker .
4,040,864 8/1977 Steeves .
4,053,412 10/1977 Stix .
4,063,761 12/1977 Pansini .
4,089,074 5/1978 Sermons .
4,420,846 12/1983 Bonner .
4,518,495 5/1985 Harding .
4,602,391 7/1986 Shepherd .
4,889,622 12/1989 Newcombe-Bond .
4,936,552 6/1990 Rothrock .
4,994,178 2/1991 Brooks .
5,043,060 8/1991 Brennan .
5,108,593 4/1992 D'Ascensio .
5,139,660 8/1992 Lourie .

FOREIGN PATENT DOCUMENTS

91/4454 3/1992 South Africa .

*Primary Examiner*—Thomas M. Lithgow
*Attorney, Agent, or Firm*—Dorn, McEachran, Jambor & Keating

[57] ABSTRACT

The device has an elongate net with an extended, open mouth. The net forms a channel-shaped volume in which floating debris from a swimming pool can be collected. A tubular frame member extends lengthwise across the mouth of the net, and floats are provided to support the net and the tubular frame member at the surface of the pool water, with the mouth of the net orientated to receive floating debris. In operation, the tubular frame member is connected to the return flow inlet of the swimming pool so as to receive a portion of the flow returning to the pool through the inlet. Sprays on the tubular frame member are directed into the net. There is also an outlet for directing another portion of the return flow of water into the swimming pool so as to create a swirling flow of water in the pool which encourages floating debris to migrate about the pool to the net.

6 Claims, 4 Drawing Sheets

POOL SKIMMING DEVICE

BACKGROUND OF THE INVENTION

This invention relates to a pool skimming device and the present application is a continuation-in-part of U.S. patent application Ser. No. 08/066,914 dated May 24, 1993, now abandoned, which was a continuation of U.S. patent application Ser. No. 07/856,460, filed Mar. 24, 1992, now abandoned.

A common problem faced by swimming pool owners in the autumn months of the year is that of leaves falling into the pool. Besides rendering the pool most unsightly, the leaves may get into the filtration system and cause damage. The falling of leaves will usually require the pool owner to use a conventional long-handled net to sweep the leaves off the surface of the pool. This is a time-consuming and unpleasant operation.

SUMMARY OF THE INVENTION

According to the present invention there is provided a swimming pool skimming device comprising an elongate net having an extended, open mouth and defining an open, channel-shaped volume where floating debris can accumulate. There is a tubular frame member extending lengthwise with respect to the open mouth of the net, and float means which are buoyant in water and which are arranged to support the net and the tubular frame member at the surface of water in a swimming pool, with the mouth of the net directed laterally in a manner to receive floating debris in the channel-shaped volume thereof. Inflow connection means are provided for connecting the tubular frame member releasably to a return flow inlet of the swimming pool so that a portion of the flow of water from the return flow inlet is directed into the tubular frame member. The tubular frame member has spray means arranged to produce water sprays directed towards the open mouth of the net when water is directed into the tubular frame member by the inflow connection means. The inflow connection means also includes an outlet means for directing another portion of the flow of water from the return flow inlet into the swimming pool in a direction to create a swirling flow of water in the swimming pool. Aeration means are provided which comprise a venturi in the outlet means and an air conduit for directing air into the outlet means under the venturi effect created when water flows through the outlet means, thereby to aerate the water flowing through the outlet means. For manual operation, there is a towing handle for towing the skimming device around the surface of water in the swimming pool when the tubular frame member is disconnected from the return flow inlet.

In the preferred embodiments, the device comprises floats to which the net is attached. There may also be floats, possibly the same floats as those to which the net is attached, to which the tubular frame member is attached.

In one version of the invention, the floats have channel shaped grooves therein for receiving opposite ends of the net and, spaced from channel shaped grooves, openings for receiving opposite ends of tubular frame member. In this version, the inflow connection includes swivel connectors which in use enable the vertical spacing of the tubular frame member and the return flow inlet to be adjusted.

BRIEF DESCRIPTION OF THE DRAWINGS

The invention will now be described in more detail, by way of example only, with reference to the accompanying drawings in which.

DESCRIPTION OF EMBODIMENTS

Figures 1, 2:
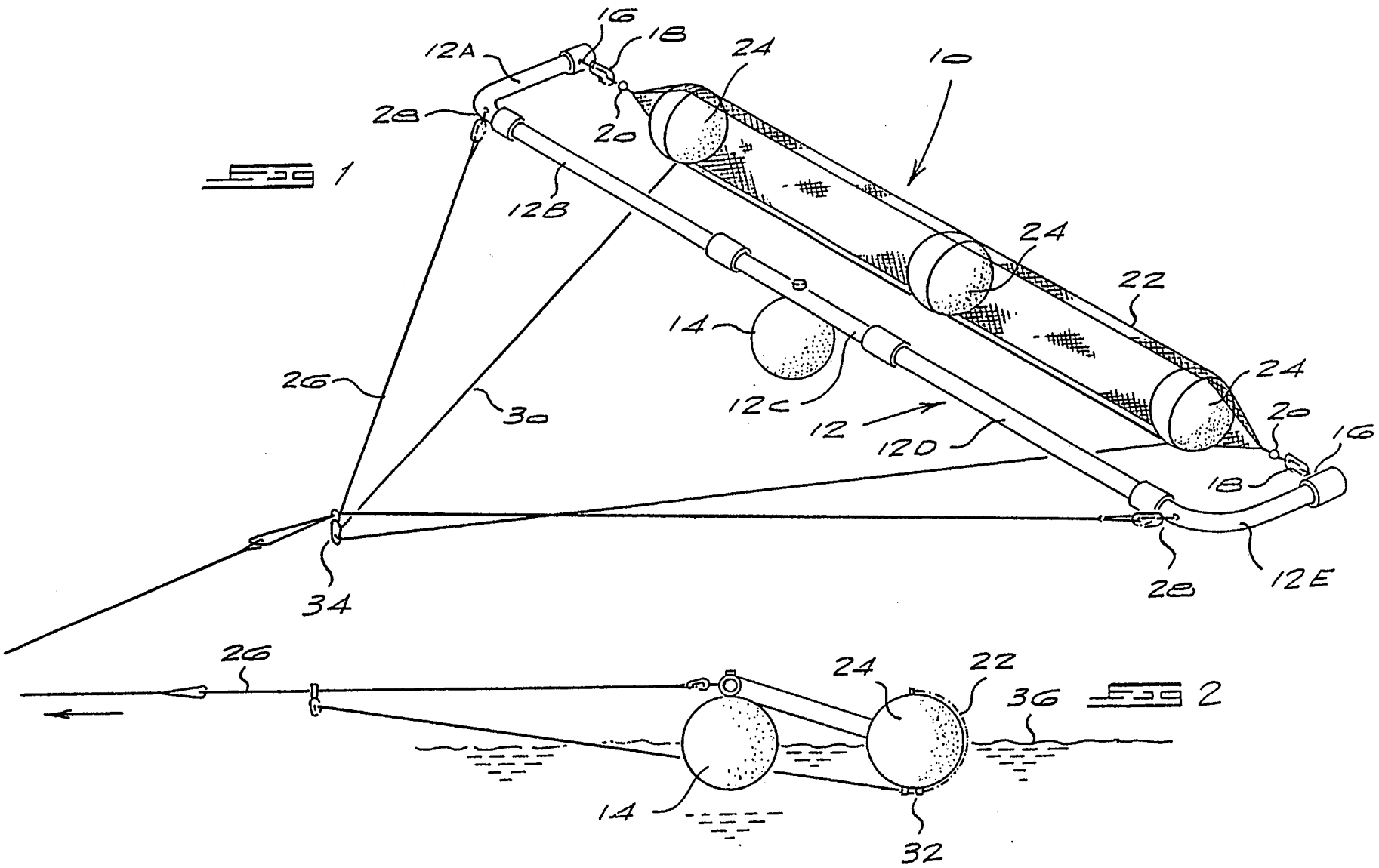
- FIG. 1 shows a perspective view of a pool skimming device according to a first embodiment of the invention.
- FIG. 2 shows a cross-sectional view of the device or FIG. 1 in use in the towing mode.

FIG. 1 shows a pool skimming device 10 of the invention. The device 10 has a tubular frame 12 member composed of sections 12A, 12B, 12C, 12D and 12E attached to one another in spigot and socket fashion to form the illustrated bow shape. The central section 12C has a ball float 14 attached to it.

Tied to the ends of the bow-shaped frame member 12 and extending inwardly therefrom are short cords 16 which carry clips 18 to which swivels 20, of the kind normally used on fishing traces, are attached. The swivels 20 are attached to opposite ends of an elongate net 22 which is formed into a channel shape in cross-section by means of ball floats 24 secured to the net material.

A towing handle 26, in the form of a length of rope, has its ends secured to the frame member 12 at points 28 as illustrated. In addition to the towing handle, there is a tilting handle 30, also in the form of a length of rope, which is in the form of an endless loop passing through eyelets 32 connected eccentrically to the ball floats 24. The handles are attached to one another at a clip 34.

FIG. 2 illustrates a first mode of use of the device 10. The device is placed in the water 36 of a swimming pool and the action of the floats 14 and 24 is to maintain the frame and net at the surface of the water and to maintain the net at the illustrated orientation, with the channel shape mouthing laterally. To ensure that this orientation of the net is maintained, the floats 24 may include lead weights at appropriate positions, the lead weights causing them to float at the same orientation in all situations.

An operator grasps the center of the towing handle and pulls the device across the surface of the pool. The orientation of the net ensures that floating debris, such as leaves, are captured by the net. The length of the net is substantial so a large proportion of the width of the pool can be swept clear of floating debris in a single pass.

Once the pool surface has been swept clear of the floating debris, the operator pulls upwardly on the towing and tilting handles to lift the device out of the water. The eccentric attachment of the tilting rope to the ball floats 24 causes the net to swivel relative to the frame member 12 to the orientation seen in FIG. 3, in which the channel-shape of the net mouths upwardly. This reorientation of the net ensures that the captured debris cannot fall out of the net when it is lifted out of the water. The device, in the FIG. 3 orientation, can now be transported to a rubbish tip and emptied of its contents.

Figures 3, 4:
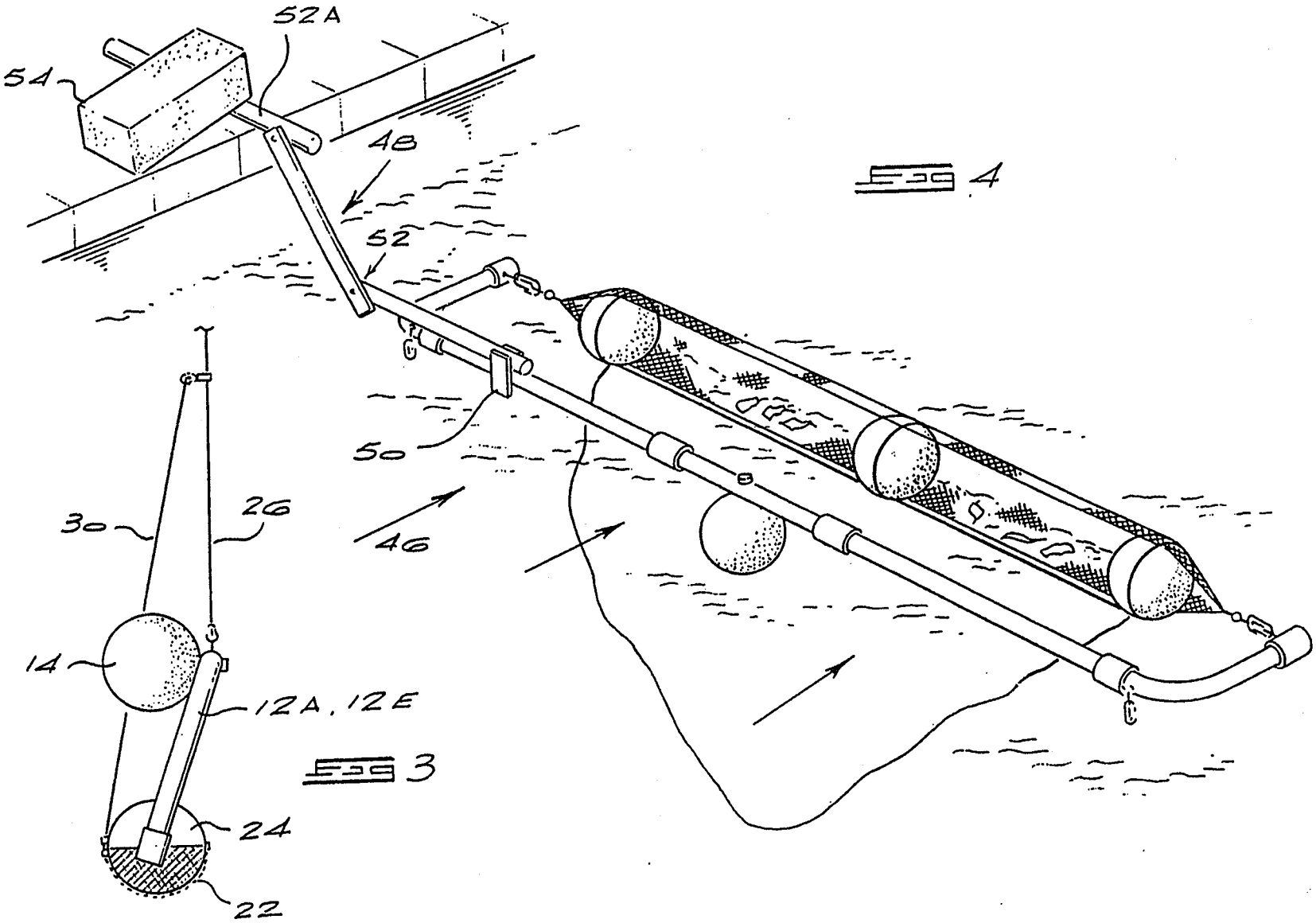
- FIG. 3 illustrates the situation when the tilting handle of the device of FIG. 1 is pulled upwardly.
- FIG. 4 shows a perspective view of the device of FIG. 1 in use in the stationary mode.

FIG. 4 shows the same device in a stationary mode adjacent the standard return flow inlet which returns water to the pool under pressure from the filtration unit (not shown). The inlet is fitted with a bend which directs the incoming water in such a direction that the water swirls around the pool in the manner indicated by the arrow 46.

In FIG. 4, the device 10 includes an anchor 48 which has a clevis 50 engaging the frame member 12, and a pivoted linkage 52 which has a terminal element 52A that rests upon the coping at the edge of the pool. The anchor 48 is secured in this position by means of a weight 54 placed upon the terminal element 52A, with the frame member and net of the device 10 extending outwardly into the pool. The net is in a position to catch floating debris transported around the pool by the swirling water. When the pool is clean, or the net full of floating debris, the operator pulls upwardly on the tilting handle to lift the device clear of the water. As before the net reorientates itself so as to mouth upwardly, thereby preventing the captured material from falling out, and the device can be carried to the rubbish tip for emptying.

When the skimming operation has been completed, the device 10 can be dismantled by detaching the swivels 20 from the clips 18, detaching the towing handle from the frame member and separating the various sections of the frame member by pulling them apart from one another. This enables the device to be stored compactly when not in use.

The net which is used to skim large leaves and floating debris from the surface of the pool will have a large aperture size to reduce drag in the water. It may however be replaced with a net having a smaller aperture size if it is desired to skim small floating particles. Alternatively, the skimming device may be supplied with a second net having a smaller aperture size which can be draped over the existing net to provide a composite net structure having an appropriately small aperture size to capture small floating particles.

Figure 5:
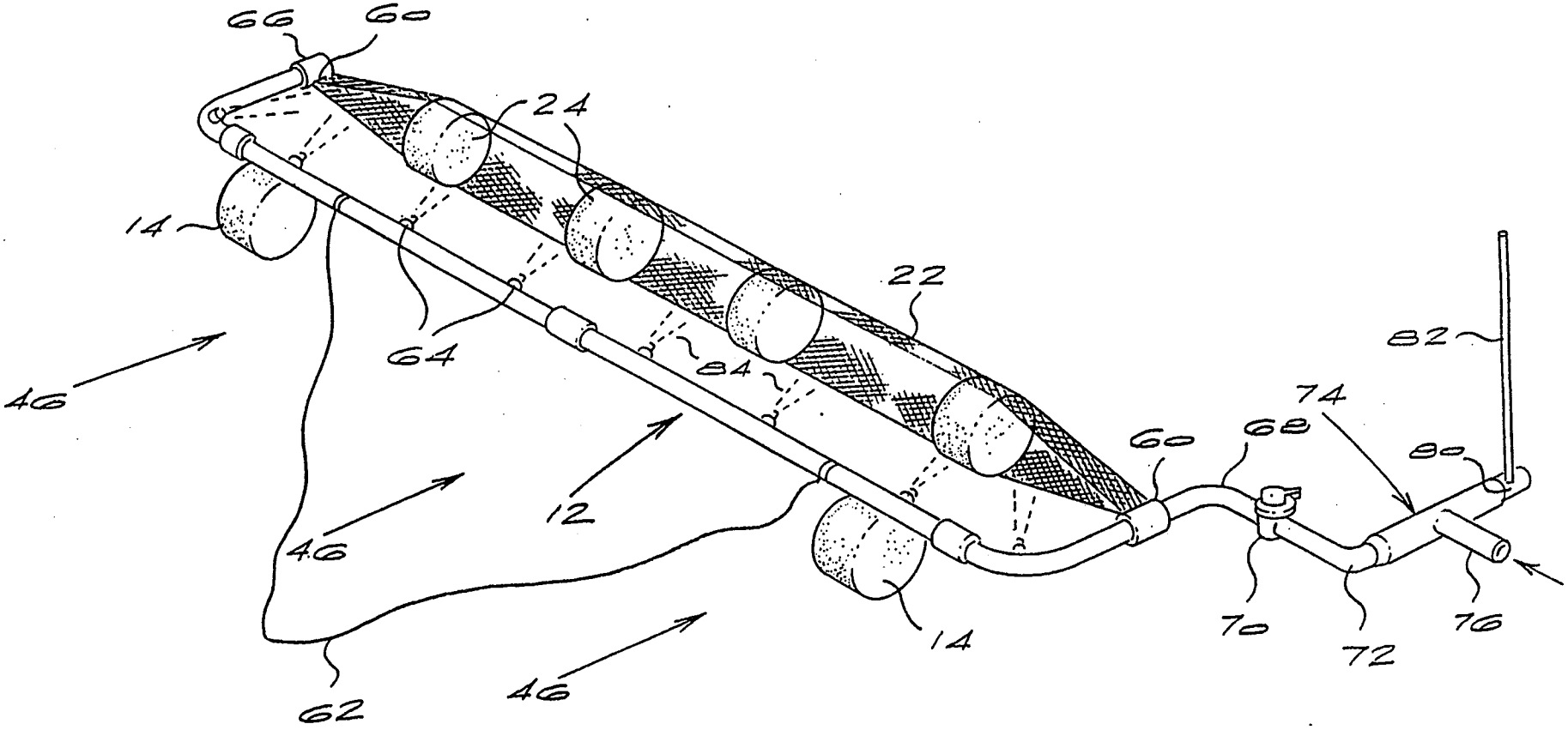
- FIG. 5 shows a view similar to that of FIG. 4 but of a second embodiment of the invention.

FIG. 5 illustrates a modified embodiment of the invention. In this Figure, components corresponding to those of FIGS. 1 to 4 are indicated with the same reference numerals.

In FIG. 5, the net 22 is secured to the bow-shaped frame member 12 by means of fasteners 60. The frame member 12 is of hollow tubular construction and, as in the first embodiment, is composed of a series of short tubular lengths connected to one another spigot and socket fashion. A single rope handle 62 is connected to the frame member 12 as illustrated.

As thus far described, the embodiment of FIG. 5 is virtually identical to the first embodiment, with the various floats 14, 24 maintaining the net 22 at an orientation in which it mouths laterally at the stirface of a swimming pool. As with the first embodiment, the handle 62 can be used to tow the skimming device across the water to collect leaves and other floating debris in the net 22. After a manual skimming operation of this kind, the handle 62 is pulled vertically upwardly, with the result that the net 22 is reorientated so as to mouth upwardly. The handle 62 can then be used to carry the device to a tip where the debris, that has accumulated in the net can be disposed of.

It will be appreciated that in the embodiment of FIG. 5, the single handle 62 performs the functions of the towing and tilting handles 26 and 30 in the first embodiment.

In FIG. 5 spray heads 64 are set into holes formed for the purpose in the frame member 12. One end 66 of the frame member 12 is plugged closed, while the other, open end has connected to it a pipe bend 68. The opposite end of the pipe bend 68 is connected via a valve 70 to a further pipe bend 72 which is in turn connected to a tee-piece 74. The branch 76 of the tee-piece 74 is dimensioned to make a friction fit in the return flow inlet through which filtered water is returned to the, swimming pool from the conventional filtration unit.

The opposite end of the tee-piece 74 has connected to it a short length of pipe 80 from which a slender conduit 82 extends. The relevant end of the conduit 82 passes through the wall of the pipe length 80 and is chamfered to establish a venturi effect when water flows through the pipe length as described below.

The various connections between the pipe bends 68 and 72, tee-piece 74 and pipe length 80 are merely frictional connections, permitting the various components to be swivelled relative to one another to appropriate orientations for the net to be supported in the illustrated manner at the surface of the water. When correctly oriented, the conduit 82 extends above the water surface.

In use with the pump of the filtration unit operational, a portion of the water flow arriving at the pool through the return flow inlet is directed into the pool through the pipe length 80. This flow of return water sets up a swirling motion in the pool similar to that described in relation to the first embodiment. With the valve 70 open, another portion of the return flow enters the frame member 12 from which it issues via the spray heads 64.

The spray heads 64 are of a known type, commonly used for garden irrigation, which are designed to produce 180° sprays. The spray heads are oriented for their sprays 84 to be directed towards the mouth of the net 22. Floating debris is conveyed about the pool due to the swirling motion, and arrives in the direction indicated by the arrows 46 to be captured by the net 22. The sprays 84 assist in forcing the debris into the mouth of the net, and in retaining it there for subsequent disposal.

To empty the net 22, the frame member 12 is disconnected from the pipe bend 68. The handle 62 is then lifted vertically to tilt the frame and net as described previously, whereafter the device can be transported to the tip.

The venturi created by the inner end of the conduit 82 causes ambient air to be sucked into the flow of water passing through the pipe length 80. It is believed that the aeration of the inflowing water could assist in purifying the pool water.

In the above embodiments there are separate floats supporting the frame member and net. In other embodiments, such as the FIG. 6 version described below, one or more single floats of appropriate shape can serve to support both the tubular member and the net.

Figure 6:
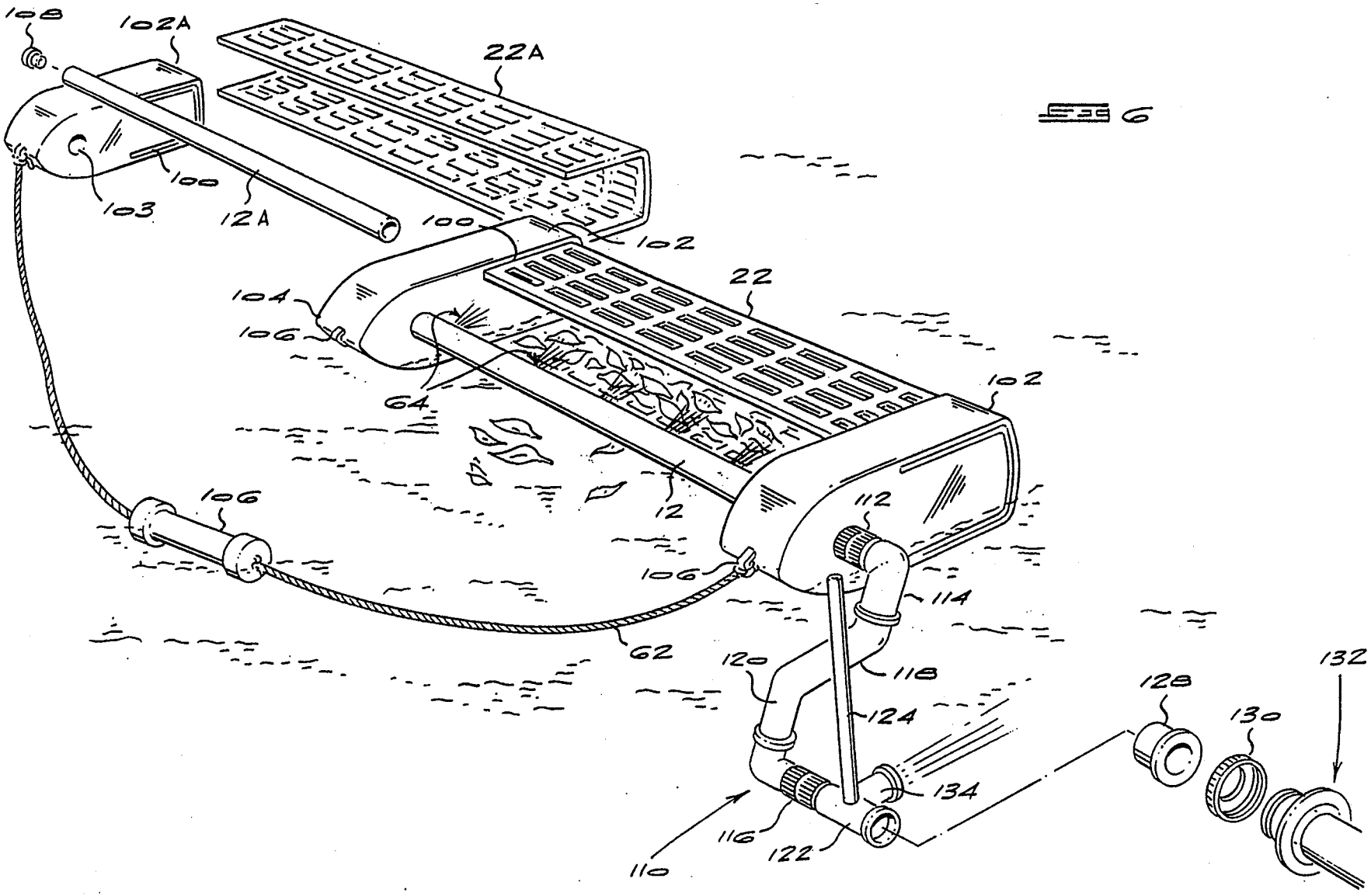
- FIG. 6 shows a partially exploded perspective view of a third embodiment of the invention.

FIG. 6 illustrates a third embodiment of the invention. Once again, components corresponding to those of the earlier embodiments are marked with the same reference numerals.

In FIG. 6, the bow-shaped frame member of the earlier embodiments is replaced by a straight tubular frame member 12. As in FIG. 5, the frame member 12 is provided with spaced apart spray heads 64 directed towards the net 22. The net 22 in this embodiment is of semi-rigid, resilient, moulded plastics construction. The opposite ends of the net are retained as interference fits in channel-shaped grooves 100 formed in spaced apart floats 102. In practice, the net 22 can be moulded either in a flat or slightly curved configuration, so that when it is bent to the illustrated channel-shape, its inherent resilience retains it securely in the groove 100.

The floats 102 are of moulded plastics construction and are somewhat bullet-shaped as illustrated. They are formed with round openings 103, near to their leading ends 104, which receive the opposite ends of the tubular frame member 12 as tight interference fits. The shape of the floats 102 enables them to float at the illustrated orientation at the surface of the water in a swimming pool, with the net 22 mouthing laterally. It will be appreciated that in the embodiment of FIG. 6, the floats 102 replace the floats 14 and 24 of the earlier embodiments.

The leading ends 104 of the floats 102 are formed with attachment points 106 to which the ends of a rope 62 are attached, the rope 62 in this case carrying a plastics grip 106 facilitating comfortable hand-engagement by a user.

It will be apparent from FIG. 6 that the pool skimming device of this embodiment is not limited to a single net, and that further tubular frames, nets and floats, designated 12A, 22A and 102A respectively, can be added to the basic unit, in extendable modular fashion, as required. In the result it is possible to build up the pool skimming device to a required overall length, merely by adding further components. The otherwise exposed opening 103 at the remote end of the device can be plugged, both to improve the aesthetics to and prevent ingress of water, by means of a plastics plug element 108.

The inflow connection apparatus consisting, in FIG. 5, of components 68, 70, 72, 74, 76, 80 and 82, is replaced in FIG. 6 by an inflow connection apparatus 110. The apparatus 110 has a first swivel connector 112 which is releasably connected to the opening 103 of the nearside (as illustrated) float 102. A cranked pipe section 114 is connected between the swivel connector 112 and a further, similar swivel connector 116, by two elbows 118 and 120.

A tee-piece 122 is connected to the swivel connector 116 and supports a standpipe 124, corresponding to the conduit 82 of FIG. 5. One end 126 of the tee-piece is fitted with a flange 128 and engages in use behind the threaded ring 130 of a conventional pool return flow inlet unit 132 which is recessed in the wall of the pool.

It will be appreciated that swivelling movements at the connectors 112, 116 will serve to raise and lower the net 22 relative to the return flow inlet, thereby permitting account to be taken of fluctuating water levels in the swimming pool.

In operation, the embodiment seen in FIG. 6 operates in the same way as that of FIG. 5, with a portion of the return flow of water passing through the branch 134 of the tee-piece into the swimming pool, and with the remainder of the flow entering the tubular frame member 12. The flow issuing from the branch 134 sets up a swirling flow in the pool, as described previously, so that leaves and other floating debris eventually migrate about the pool towards the net 22. The sprays emanating from the spray heads in the tubular frame member 12 assist in driving the leaves into the net and in retaining them there. It will be appreciated that where the pool skimming device includes a number of tubular frame members 12 arranged end-to-end as described above, the water flow which is not lost through the sprays in any one frame is able to pass on to the next frame, and so on.

As before, the device can be disconnected from the return flow inlet when the net is full of leaves and floating matter, with the handle 62 then being used to lift the net clear of the water for emptying thereof at a remote dump site. It will also be appreciated that the device can also be towed manually about the pool surface by the handle 62. In this connection the modular nature of the FIG. 7 embodiment, with the facility for creating a long expanse of net 22, will enable a considerable surface area to be swept for leaves and floating matter in a single pass.

A special feature of the FIG. 6 embodiment arises out of the use of bullet-shaped floats 102 as illustrated. The symmetrical shape of each float enables the entire skimming apparatus to be flipped over so that the net mouths in the opposite direction.

It would of course be necessary to swivel the pipework components to the appropriate orientations to suit the new orientation of the net, and to ensure that the branch 134 points in the right direction to set up the swirl of swimming pool water in the opposite direction.

It should also be noted that, while reference has been made to the use of spray heads on the tubular frame member, suitable spray means can also be provided merely by apertures formed in the tubular member.

I claim:

1. A swimming pool skimming device comprising:

an elongate net having an extended, open mouth and defining an open, channel-shaped volume where floating debris can accumulate, a tubular frame member connected to said net and extending lengthwise with respect to the open mouth of the net, float means which are buoyant in water and which are arranged to support the net and the tubular frame member at the surface of water in a swimming pool, with the mouth of the net directed laterally in a manner to receive floating debris in the channel-shaped volume thereof, inflow connection means for connecting the tubular frame member releasably to a return flow inlet of the swimming pool so that a portion of the flow of water from the return flow inlet is directed into the tubular frame member, spray means on the tubular frame member to produce water sprays, directed towards the open mouth of the net, when water is directed into the tubular frame member by the inflow connection means, the inflow connection means also including an outlet means for directing another portion of the flow of water from the return flow inlet into the swimming pool in a direction to create a swirling flow of water in the swimming pool, aeration means comprising a venturi in the outlet means and an air conduit for directing air into the outlet means under the venturi effect created when water flows through the outlet means, thereby to aerate the water flowing through the outlet means, and a towing handle connected to said frame for towing the skimming device around the surface of water in the swimming pool when the tubular frame member is disconnected from the return flow inlet.

2. A swimming pool skimming device according to claim 1 wherein said float means comprises floats to which the net is attached.

3. A swimming pool skimming device according to claim 2 wherein said float means comprises floats to which the tubular frame member is attached.

4. A swimming pool skimming device according to claim 3 wherein the floats have channel shaped grooves therein for receiving opposite ends of the net and, spaced from the channel shaped grooves, openings for receiving opposite ends of the tubular frame member.

5. A swimming pool skimming device according to claim 4 wherein the inflow connection means includes swivel connectors which in use enable the vertical spacing of the tubular frame member and the return inlet to be adjusted.

6. A swimming pool skimming device according to claim 1 wherein the spray means are provided by apertures in the tubular frame member.

* * * * *